US012638013B2

(12) United States Patent
Wu et al.

(10) Patent No.: US 12,638,013 B2
(45) Date of Patent: May 26, 2026

(54) HYDRAULIC LINKAGE PLUNGER PUSHING MECHANISM AND PLUNGER DIAPHRAGM PUMP USING SAME

(71) Applicant: SHANGHAI NIKUNI FLUID SYSTEM CO., LTD., Shanghai (CN)

(72) Inventors: Xinlin Wu, Shanghai (CN); Fengwei Liu, Shanghai (CN)

(73) Assignee: SHANGHAI NIKUNI FLUID SYSTEM CO., LTD., Shanghai (CN)

( * ) Notice: Subject to any disclaimer, the term of this patent is extended or adjusted under 35 U.S.C. 154(b) by 0 days.

(21) Appl. No.: 18/566,611

(22) PCT Filed: Aug. 19, 2022

(86) PCT No.: PCT/CN2022/113617

§ 371 (c)(1),
(2) Date: Dec. 1, 2023

(87) PCT Pub. No.: WO2023/168910

PCT Pub. Date: Sep. 14, 2023

(65) Prior Publication Data

US 2024/0263626 A1 Aug. 8, 2024

(30) Foreign Application Priority Data

Mar. 10, 2022 (CN) ..... 202210233069.3

(51) Int. Cl.

| | |
|---|---|
| ***F04B 43/067*** | (2006.01) |
| ***F04B 43/00*** | (2006.01) |
| ***F04B 43/06*** | (2006.01) |
| ***F04B 43/073*** | (2006.01) |
| ***F04B 53/00*** | (2006.01) |
| ***F04B 53/10*** | (2006.01) |

(52) U.S. Cl.

CPC ..... *F04B 43/067* (2013.01); *F04B 43/0081* (2013.01); *F04B 43/06* (2013.01); *F04B 43/073* (2013.01); *F04B 53/006* (2013.01); *F04B 53/10* (2013.01)

(58) Field of Classification Search

CPC ..... F04B 43/067; F04B 43/073; F04B 43/06; F04B 43/0081

See application file for complete search history.

(56) References Cited

U.S. PATENT DOCUMENTS

| | | | | |
|---|---|---|---|---|
| 4,068,982 A * | 1/1978 | Quarve | ..... | F04B 43/067 417/387 |
| 5,707,219 A * | 1/1998 | Powers | ..... | F04B 43/067 417/387 |
| 6,071,089 A * | 6/2000 | Maier | ..... | F02M 59/14 417/388 |

* cited by examiner

*Primary Examiner* — Peter J Bertheaud
(74) *Attorney, Agent, or Firm* — Che-Yang Chen

(57) ABSTRACT

A hydraulic linkage plunger pushing mechanism for a plunger diaphragm pump body with a low-pressure liquid chamber and a plunger, includes: a bearing component; and a crankshaft disposed in the low-pressure liquid chamber in the plunger diaphragm pump body through the bearing component, the crankshaft comprising an eccentric part, and the eccentric part of the crankshaft sleeved with a bearing; wherein in case where the crankshaft rotates along a crankshaft axis thereof, the bearing disposed at the eccentric part of the crankshaft pushes the plunger to compress.

3 Claims, 15 Drawing Sheets

HYDRAULIC LINKAGE PLUNGER PUSHING MECHANISM AND PLUNGER DIAPHRAGM PUMP USING SAME

CROSS REFERENCE OF RELATED APPLICATION

This application claims the benefit under 35 U.S.C. § 119 from International Application No. PCT/CN2022/113617, which claims priorities to CN 202210233069.3, filed Mar. 10, 2022, the entire contents of which are hereby incorporated by reference in their entireties for teachings of additional or alternative details, and/or features.

TECHNICAL FIELD

The present disclosure relates to the field of pump technology, in particular to a hydraulic linkage plunger pushing mechanism and a plunger diaphragm pump.

DESCRIPTION OF RELATED ARTS

At present, piston pumps on the market are mainly crankshaft connecting rod structures and swash plate push-pull structures. Because there is a certain gap between the connecting rod and the crankshaft, the operation is unstable and the efficiency is low; Moreover, the crankshaft connecting rod structure often occupies more space, which makes the product bulky and heavy. Because of the design defects of traditional crankshaft connecting rod structures, it is easy to increase mechanical wear and damage the crankshaft connecting rod structure, and at the same time, it is easy to increase the oil temperature in the hydraulic drive mechanism, which will further lead to the emulsification of hydraulic oil in the hydraulic drive mechanism and lose lubrication performance. The swashplate push-pull structure has a large movement range, and the sliding friction between the swashplate and the plunger is large, which is easy to occur wear of parts, excessive power loss, and oil temperature rise.

More importantly, it is easy to bring damage risk to the plunger diaphragm pump under the condition of overpressure of oil pressure, such as plunger spring fracture and diaphragm damage.

SUMMARY OF THE PRESENT INVENTION

The purpose of the present disclosure is to solve the above problems, and to provide a hydraulic linkage plunger pushing mechanism with radial and axial forces. Its structure is more compact, simple, and has a low working wear coefficient. The internal oil temperature of the hydraulic pushing mechanism does not increase significantly, and the lubricating oil is cleaner and does not need to be replaced frequently. On this basis, the present disclosure also provides a plunger diaphragm pump using the hydraulic linkage plunger pushing mechanism combined with the radial and axial forces.

In order to achieve the above purpose, the present disclosure adopts the following technical scheme:

The hydraulic linkage plunger pushing mechanism has: a crankshaft with a low-pressure liquid chamber disposed in a plunger diaphragm pump body through a bearing component, the crankshaft provided with an eccentric part, and the eccentric part of the crankshaft provided with a bearing; in a case where the crankshaft rotates along a crankshaft axis, the bearing disposed at the eccentric part of the crankshaft pushing the plunger to compress.

It can be seen from the above content that the hydraulic linkage plunger pushing mechanism of the present disclosure skillfully uses the design of crankshaft+bearing+eccentricity to overcome the problem of large mechanical wear of the hydraulic unit driven by the swash plate push head in the traditional plunger diaphragm pump. The bearing is disposed at the eccentricity of the crankshaft, and the outer ring of the bearing and the push head are closely fitted without relative motion. The relative motion is realized by the rolling bearing, and the crankshaft is pushed by the rolling bearing to complete the compression action of the corresponding plunger. The outer ring of the bearing is not directly worn with the plunger, avoiding the factors of high oil temperature caused by the large mechanical action range of the traditional swash plate push head and the large wear of the sliding friction machinery. The oil temperature in the low-pressure liquid chamber is greatly reduced. In the actual operation process, the oil temperature in the low-pressure liquid chamber does not increase significantly. More importantly, due to the high wear coefficient, the eccentric push-head-driven hydraulic unit in the traditional plug diaphragm pump directly leads to mechanical wear and reduces product life. At the same time, the eccentric push-head-driven hydraulic unit in the traditional plug diaphragm pump will also indirectly lead to an increase in the oil temperature of the low-pressure liquid chamber. The consequence of the increase in oil temperature is emulsification and deterioration, which will cause the lubrication capacity of the action mechanism of the eccentric push-head-driven hydraulic unit to decrease. The decrease in lubrication capacity further causes the action mechanism of the eccentric push-head-driven hydraulic unit to wear more during the plunger push action. The above process is a vicious cycle, and the present disclosure effectively avoids the above vicious cycle process. The above mechanism provided by the present disclosure can meet the structural design requirements of single plunger and multiple plungers (the number is greater than 2, such as 3, 4, 5, 6, 7, 8, 9 . . . ). In the case of continuous rotation of the crankshaft, the motor connected by the crankshaft can control the liquid delivery by adjusting the motor speed, and has a relatively stable quantitative liquid delivery capacity.

In the hydraulic linkage plunger pushing mechanism of the present disclosure, a wheelbase between an eccentric axis of the eccentric part and a crankshaft axis is b (for each rotation of the shaft, the stroke of a single plunger=b×2, corresponding to the volume of liquid discharged from each plunger=b×2×plunger cross-sectional area); An eccentric column is formed around the eccentric axis; an eccentric cylinder is formed around the eccentric axis. The eccentric cylinder is disposed on the crankshaft as an eccentric body. If the eccentric part is directly pushed against the plunger, there will be a large wear and tear and the oil temperature will be affected. As a rotating part, the eccentric cylinder can cooperate well with the bearing assembly. At this time, the inner ring of the bearing on the eccentric cylinder is fixed on the crankshaft and accompanied by the rotation of the crankshaft. The speed of the outer ring of the bearing can be different from that of the inner ring of the bearing, and the speed of the crankshaft does not need to be synchronized. The outer ring of the bearing only needs to slide (roll) the push head of the contact plunger to complete the compression action of the plunger in a case where the eccentricity is biased towards the corresponding plunger. Compared with the traditional mechanical structure, the sliding (rolling) contact method has a lower mechanical wear coefficient.

In the hydraulic linkage plunger pushing mechanism of the present disclosure, the eccentric column is provided with a stop ring coaxial with the eccentric axis. The stop ring can better limit the stop movement of the bearing inner ring and avoid the axial movement of the bearing. Because the outer diameter of the stop ring is larger than the outer diameter of the eccentric cylinder, a large cross-section difference between the eccentric cylinder and the variable diameter structure section is avoided, and the structural strength of the crankshaft is affected.

In the hydraulic linkage piston pushing mechanism of the present disclosure, the crankshaft is provided with a variable diameter structure section coaxial with the crankshaft axis. The variable diameter structure section has multiple structural sections with gradually decreasing outer diameter from the first end to the second end. The structure can strengthen the structural strength of the crankshaft and allow the crankshaft to be better assembled to the piston cylinder body and limit the assembly structure well.

In the hydraulic linkage plunger pushing mechanism of the present disclosure, the plunger is provided with a spherical surface, and the spherical surface is provided with a push head. The spherical surface design of the plunger can further reduce the friction problem in the process of power transmission, and promote the cylindrical push head body and the ball cap disposed on the cylindrical push head body. The joint cooperation is smoother, which not only allows the bearing to directly roll (slide) and press the free end of the cylindrical push head body of the push head, but also allows the push head itself to avoid the problem of high wear in the transmission of power. The oil in the low-pressure liquid chamber will lubricate the joint position well.

The hydraulic linkage plunger pushing mechanism of the present disclosure also includes a diaphragm driving and protecting integrator disposed at a liquid accumulation plate of the plunger diaphragm pump body. A one-way replenishment valve and a one-way pressure relief valve are disposed axially inside the diaphragm driving and protecting integrator. The function of the one-way replenishment valve is to prevent the pressure in the drive liquid chamber from being lower than that in the low-pressure liquid chamber, and to achieve the purpose of low-pressure protection. At the same time, due to the leakage of some oil between the plunger and the plunger cylinder, the one-way replenishment valve plays a role in replenishing the oil. The function of the unidirectional pressure relief valve is to prevent the occurrence of excessive pressure in the driving liquid chamber, resulting in excessive accumulation of hydraulic pressure in the plunger chamber and failure to release, resulting in problems such as fracture and fragmentation of the plunger spring and tear of the diaphragm, and achieving the purpose of high-pressure protection.

In the hydraulic linkage plunger pushing mechanism of the present disclosure, the diaphragm driving and protecting integrator is provided with a diaphragm driving connecting rod with an inner channel. A side wall of the diaphragm driving connecting rod is provided with at least one multifunctional opening near the diaphragm. The side wall of the diaphragm driving connecting rod is also provided with a rehydration opening for rehydration, and the diaphragm driving connecting rod is provided with a return spring.

In the hydraulic linkage plunger pushing mechanism of the present disclosure, the diaphragm driving and protecting integrator includes:

A one-way rehydration valve for preventing the pressure in the driving fluid chamber lower than the pressure in the low-pressure fluid chamber, A one-way pressure relief valve for preventing excessive pressure in the driving liquid chamber.

In the hydraulic linkage piston pushing mechanism of the present disclosure, the diaphragm driving and protecting integrator includes an integrator carrier and an integrator inner core disposed at the integrator carrier, the integrator inner core includes a core column and an annular body disposed at the core column, the core column provided with a diaphragm driving connecting rod of a diaphragm driving connecting rod return spring (one end of the diaphragm driving connecting rod return spring is limited (countered) on the outlet limit surrounding part (**11-1*b*-1) of the integrator carrier neck (11-1*b*), and the other end is limited (countered) on the step part of the diaphragm driving connecting rod 8-4**), the annular body provided with at least one unidirectional rehydration valve assembly channel and at least one unidirectional pressure relief valve assembly channel, the unidirectional rehydration valve assembly channel provided with a unidirectional rehydration valve ball, the unidirectional rehydration valve assembly channel provided with a unidirectional rehydration valve ball, the integrator inner core fixing device disposed at an annular inner groove of the cylindrical bearing body of the integrator carrier, and an annular retaining ring with a one-way pressure relief valve ball outlet limiting structure disposed between the integrator inner core fixing device and the integrator inner core. A pressure relief side hole connected to the unidirectional pressure relief valve assembly channel is disposed near the top surface of the annular body, a plurality of second rehydration openings are disposed circumferentially near the top surface of the core column of the annular body, the top surface of the integrator inner core and the fluid replenishment valve ball of the integrator carrier are protruded, and a slow flow chamber is formed between the turning part of the inner shoulder of the integrator carrier.

A plunger diaphragm pump includes the hydraulic linkage plunger push mechanism.

If not otherwise specified, the following technical features in the full text have the same meaning: diaphragm driving and protecting integrator and plunger valve; diaphragm drives connecting rod and diaphragm plunger; diaphragm drives connecting rod return spring and offset spring.

In a plunger diaphragm pump provided by the present disclosure, the plunger diaphragm pump has a plunger cylinder block, and a plunger plate is disposed on one side of the plunger cylinder block. There is a low-pressure liquid chamber and a driving liquid chamber between the plunger cylinder block and the plunger plate. The plunger plate is disposed at the first end of the crankshaft assembly chamber, and the plunger cylinder block is disposed at the second end of the crankshaft assembly chamber.

In a plunger diaphragm pump provided by the present disclosure, an oil pressure dynamic balance system of the driving liquid chamber is disposed between the low-pressure liquid chamber and the driving liquid chamber.

The present disclosure provides a plunger diaphragm pump including a body, the body has a plunger cylinder, a liquid loading plate is disposed on one side of the plunger cylinder, a low-pressure liquid chamber and a driving liquid chamber are disposed between the plunger cylinder and the liquid loading plate, a crankshaft is disposed at the low-pressure liquid chamber, a bearing is disposed at the eccentric part of the crankshaft, a plunger is disposed at the plunger cylinder, a return spring is disposed on one side of the plunger, a spherical surface is disposed on the other side of the plunger, a push head is disposed at the spherical surface, the push head and the bearing are matched, a diaphragm driving and protecting integrator is disposed at the liquid loading plate, a diaphragm driving connecting rod is disposed at the diaphragm driving and protecting integrator, and a return spring is disposed at the diaphragm driving connecting rod;

The pump body and pump cover are disposed in turn on the side of the plunger plate away from the plunger diaphragm. There is a pump cavity at the pump body. The diaphragm is disposed near the diaphragm driving connecting rod in the pump cavity. The diaphragm and the diaphragm driving connecting rod are connected. The inlet and outlet are disposed at the position where the pump cavity is away from the diaphragm driving connecting rod. The inlet one-way check valve is disposed at the inlet and the outlet one-way check valve is disposed at the outlet.

It can be seen from the above structure that the plunger diaphragm pump has the following beneficial effects: (1) Radial plunger arrangement, reciprocating motion is formed by the combined action of crankshaft and spring, and the bearing on the crankshaft are passed to the plunger. Its advantages are compact structure, smooth operation, small friction, and high efficiency. (2) The diaphragm structure ensures zero leakage of the transported medium, no medium loss, and no environmental pollution. (3) Diaphragm disposed with low-pressure and high-pressure protection to ensure that the long-term operation of the diaphragm is not damaged.

The application scope of the plunger diaphragm pump includes: high-pressure transportation of various pure liquids, solvents and chemical liquids, corrosive liquids, liquefied gas, slurry; and high-viscosity materials; The plunger diaphragm pump is also adapted for high-pressure filtration and separation equipment, high-pressure cleaning equipment, high-pressure cooling equipment, seawater desalination and reverse osmosis equipment, oil and gas field pressure water injection equipment, spray drying equipment, deep hole processing equipment, high voltage direct current boiler, multi-channel reactor and high-pressure infusion equipment which needs general quantitative requirements.

DETAILED DESCRIPTION OF THE EMBODIMENTS

In order to make the technical means, creative characteristics, purpose and efficacy of the present disclosure easy to understand, the following is combined with specific implementation examples to further elaborate the present disclosure.

Embodiment 1

Figure 1:
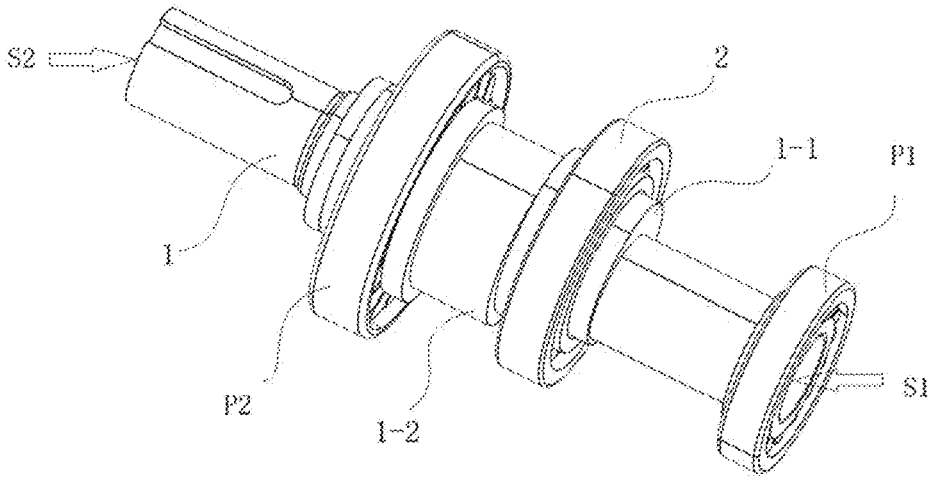
FIG. 1 is a three-dimensional view of the crankshaft of hydraulic linkage plunger pushing mechanism in Embodiment 1. The view shows the bearings disposed on the eccentric part of the crankshaft and the first assembly bearing for assembling the crankshaft to the plunger cylinder body, and the second assembly bearing for assembling the crankshaft to the liquid accumulation plate.
Figure 2:
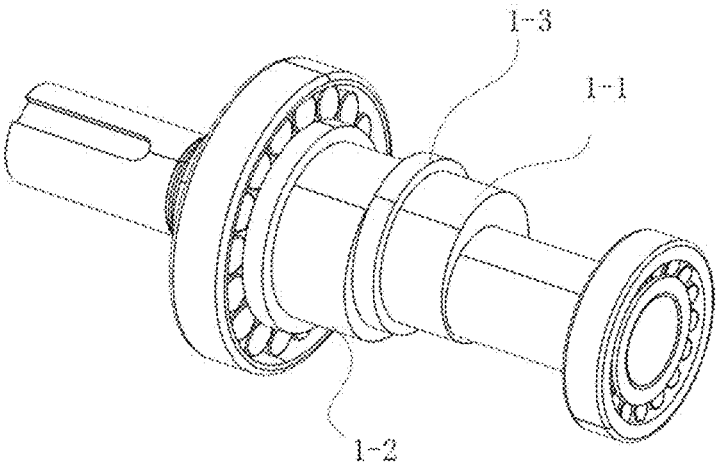
FIG. 2 is a three-dimensional view of FIG. 1, omitting the bearing.
Figure 3:
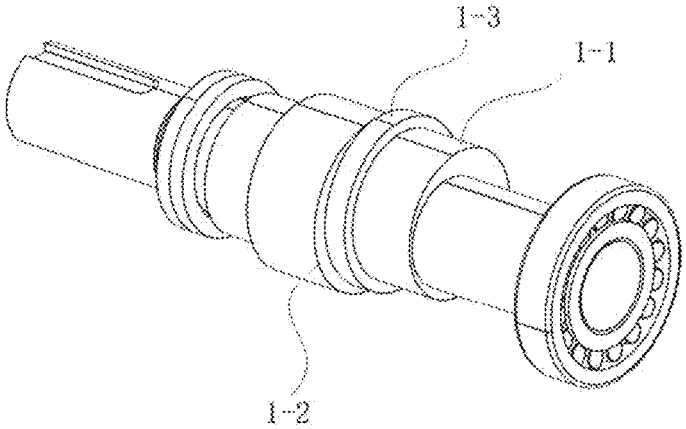
FIG. 3 is a three-dimensional view of FIG. 1, omitting the first assembled bearing.
Figure 4:
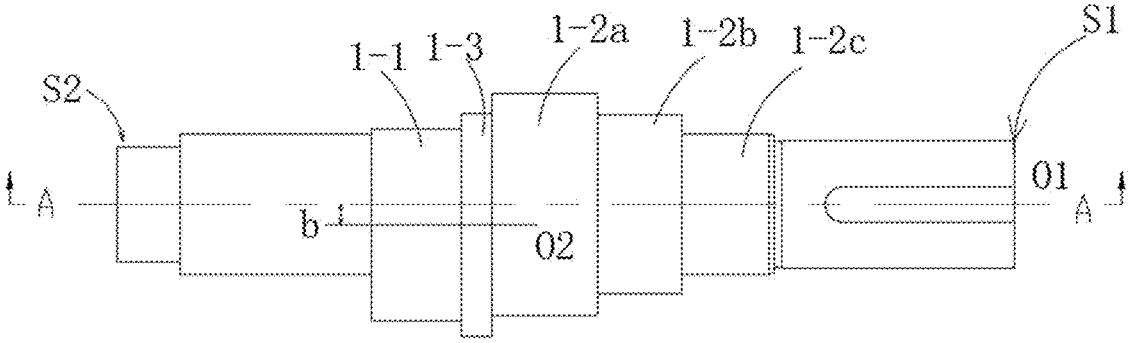
FIG. 4 is a front view of the crankshaft in the hydraulic linkage plunger pushing mechanism in Embodiment 1.
Figure 5:
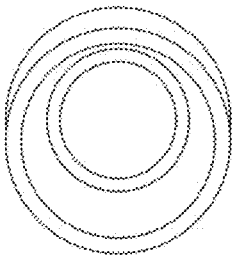
FIG. 5 is a left view of the crankshaft in the hydraulic linkage plunger pushing mechanism in Embodiment 1.
Figure 6:
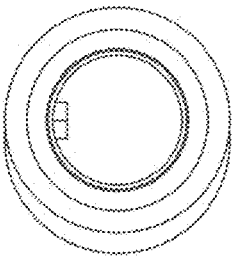
FIG. 6 is a right view of the crankshaft in the hydraulic linkage plunger pushing mechanism in Embodiment 1.
Figure 7:
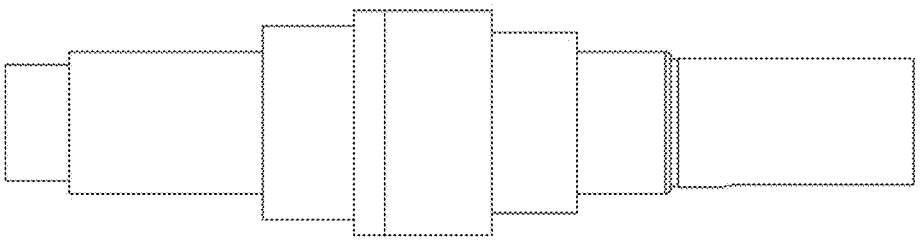
FIG. 7 is a top view of the crankshaft in the hydraulic linkage plunger pushing mechanism in Embodiment 1.
Figure 8:
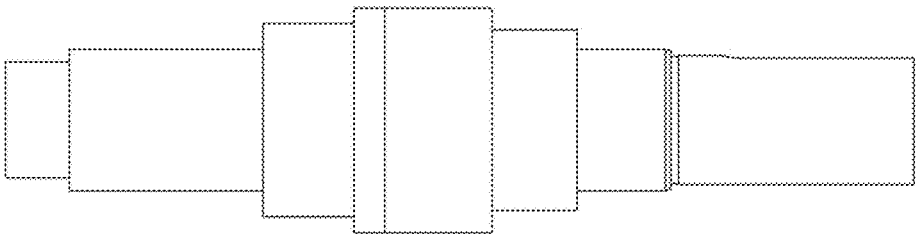
FIG. 8 is an elevation view of the crankshaft in the hydraulic linkage plunger pushing mechanism in Embodiment 1.
Figure 9:
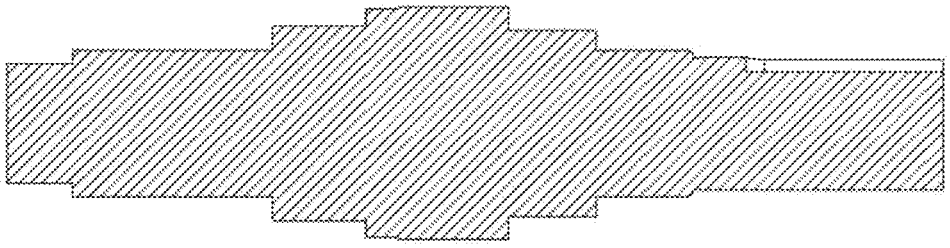
FIG. 9 is a sectional view in FIG. 4 along the A-A line.

Referring to FIGS. 1-3, a hydraulic linkage plunger push mechanism (hereinafter referred to as "the mechanism") is adapted for a plunger diaphragm pump, the mechanism includes a crankshaft 1 mounted to a low-pressure liquid chamber provided in the plunger diaphragm pump body through a bearing assembly, the bearing assembly for mounting the crankshaft having a second mounting bearing P2 for mounting the crankshaft to a plunger cylinder block, and a first mounting bearing P1 for mounting the crankshaft to a liquid accumulation plate, all of which are immersed in the low-pressure liquid chamber, the crankshaft being provided with an eccentric part 1-1.

Combined with FIGS. 4-9, the wheelbase between the eccentric axis O2 where the eccentric part is located and the axis O1 of the crankshaft 1 is b, and the wheelbase is selected according to the needs. An eccentric column is formed around the eccentric axis, and this eccentric column is disposed on the crankshaft 1 as an eccentric body. If the eccentric part is directly used to directly contradict the push of the plunger, problems such as great wear and oil temperature (oil temperature in the low-pressure liquid chamber) will occur at this time. Because the eccentric part of the crankshaft 1 is sleeved with a bearing 2, and the eccentric column body can be used as a rotary piece to be well matched with the bearing assembly, at this time, the bearing inner ring on the eccentric column body is fixed on the crankshaft and accompanied by the crankshaft rotation, the rotating speed of the bearing outer ring can be different from that of the bearing inner ring, without synchronizing the crankshaft rotating speed, and the bearing outer ring only needs to slide (roll) to contact the push head 3 of the plunger under the condition that the eccentric part is biased towards the corresponding plunger to complete the compression action of the plunger. Compared with the traditional mechanical structure, the sliding (rolling) contact mode has a lower mechanical wear coefficient. It can be seen that in a case where the crankshaft rotates along the center of the crankshaft, the bearing disposed at the eccentric part of the crankshaft pushes the plunger to complete the compression action.

Continue to as shown in FIGS. 1-9, The eccentric cylindrical body is provided with a stop ring 1-3 coaxial with the eccentric axis, The outer diameter of the stop ring is larger than that of the eccentric columnar body. The stop ring 1-3 can better limit to stop of the inner ring of the bearing, and axial movement of the bearing is avoided. The crankshaft is provided with a variable diameter structural section 1-2 coaxial with the axis of the crankshaft having a plurality of structural sections whose outer diameter gradually decreases from the first end S1 toward the second end S2. The end of the crankshaft connected to the motor is defined as the second end S2, and the end of the crankshaft mounted on the liquid accumulation plate is defined as the first end S1. Alternatively, the variable diameter structural section 1-2 is provided with at least a first coaxial column 1-2 (having an outer diameter larger than the eccentric column), a second coaxial column 1-2*b* (having a first mounting bearing P1, having an outer diameter smaller than the eccentric column), a third coaxial column 1-2*c*. The first coaxial column is the same as the axis O1 of the crankshaft. Therefore, the structure can strengthen the structural strength of the crankshaft, and at the same time, the crankshaft can be better assembled to the plunger cylinder block and the assembly structure can be well limited. The first end S1 of the crankshaft is provided with a keyway connected with the motor, while the second end S2 of the crankshaft is provided with a second assembly bearing installation reduction section slightly smaller than the outer diameter of the crankshaft main shaft.

Figure 10:
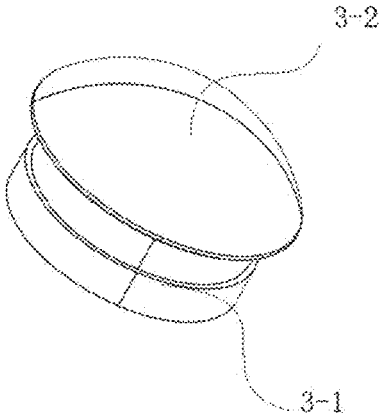
FIG. 10 is a three-dimensional view of the push head in Embodiment 1.
Figure 11:
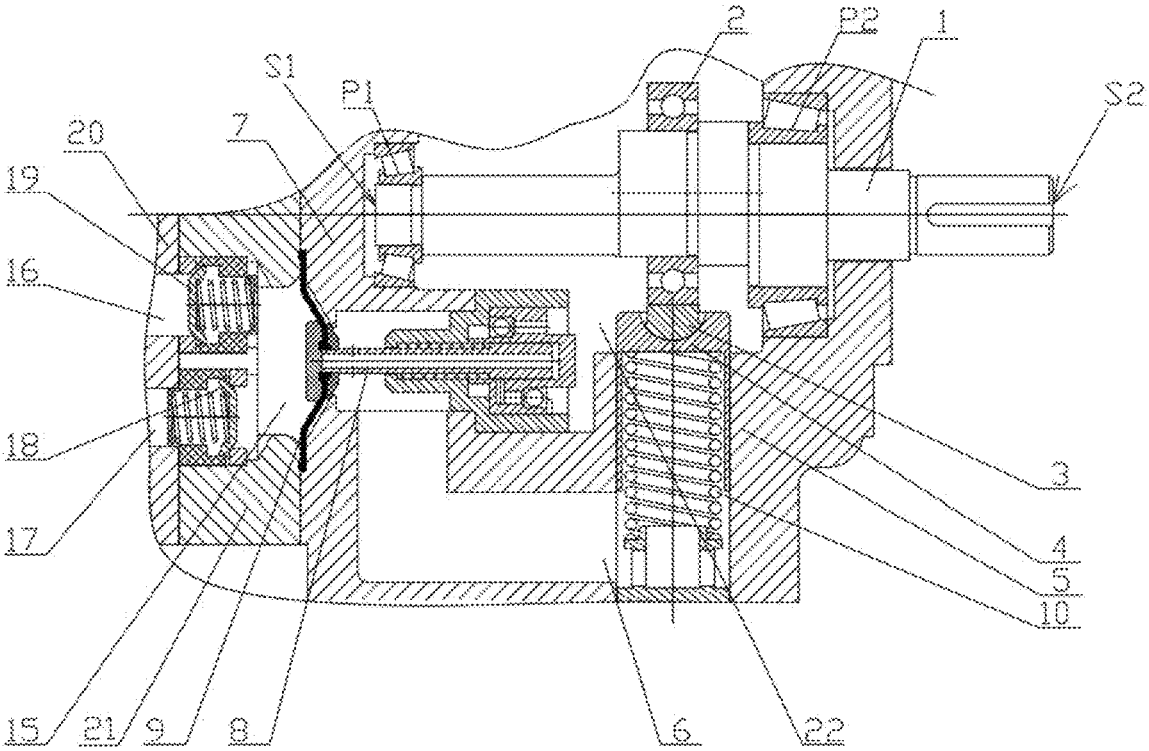
FIG. 11 is a partially sectional view of the hydraulic linkage plunger pushing mechanism disposed in the plunger diaphragm pump in embodiment 1, and some structures are omitted in the drawing.

The hydraulic linkage plunger pushing mechanism of the present disclosure skillfully utilizes crankshaft+bearing+eccentric design to overcome the problem of large mechanical wear of swashplate push head driving hydraulic unit in a traditional plunger diaphragm pump. Bearings are disposed at the eccentricity of the crankshaft, and the outer ring of the bearing is closely attached to the push head without relative movement. The relative movement is realized by the rolling bearing, the crankshaft pushes the corresponding plunger through the rolling bearing to compress, and the bearing outer ring does not wear directly with the plunger, thus avoiding the factors of oil temperature rise caused by the large mechanical action range of the traditional swashplate push head and the large mechanical wear of sliding friction, thus greatly reducing the oil temperature in the low-pressure liquid chamber, and the oil temperature in the low-pressure liquid chamber has no obvious increase in the actual operation process. More importantly, the high wear coefficient of the eccentric push head driven hydraulic unit in the traditional plug diaphragm pump directly leads to mechanical wear and reduces the product life, and at the same time indirectly leads to the oil temperature rise in the low-pressure liquid chamber. The result of the oil temperature rise is emulsification and deterioration. The process is a vicious circle, and the present disclosure effectively avoids the process of the vicious circle. The mechanism provided by the present disclosure can meet the structural design requirements of single plunger and multiple plungers, and the number of multiple plungers is greater than 2, for example, 3, 4, 5, 6, 7, 8, 9. The motor connected by the crankshaft can control the liquid conveying amount by adjusting the rotating speed of the motor under the condition of continuous rotation of the crankshaft, and has a relatively stable quantitative liquid conveying capacity:

FIG. 11 shows the hydraulic linkage plunger pushing mechanism disposed in the plunger diaphragm pump. The plunger diaphragm pump has a plunger cylinder block 5, a liquid accumulation plate 7 disposed on one side of the plunger cylinder block, a low-pressure liquid chamber 22, and a driving liquid chamber 6 between the plunger cylinder block 5 and the liquid accumulation plate 7. The liquid accumulation plate is provided with a crankshaft first end assembly chamber. The plunger cylinder block is provided with a crankshaft assembly chamber. The first end S1 of the crankshaft is disposed in the first assembly chamber through a first assembly bearing P1, and the second end S2 is disposed in the second assembly chamber through a second assembly bearing P2. The bearings at the two ends are sleeved on the crankshaft so as to realize high-speed rotation in the low-pressure liquid chamber with an external. As can be seen in FIG. 11, a plunger 4 is disposed in the plunger cylinder 5, and the plunger 4 is provided with a return spring 10. In the hydraulic linkage plunger pushing mechanism of the present disclosure, the plunger 4 is provided with a spherical surface, the spherical surface is a concave spherical surface, and a push head 3 is disposed at the spherical surface (in FIG. 10). The spherical surface design of the plunger can further reduce the friction problem in the force transmission process. Referring to FIG. 10, the push head has a cylindrical push head body 3-1 and a ball cap 3-2 disposed on the cylindrical push head body. The ball cap 3-2 is located on the concave spherical surface of the plunger. The joint cooperation is smoother, which not only allows the bearing to directly roll (slide) and press the free end of the cylindrical push head body of the push head, but also allows the push head itself to avoid the problem of high wear in the transmission of power. The oil in the low-pressure liquid chamber will lubricate the joint position well.

In FIG. 11, a pump body 21 and a pump cover 20 are disposed in turn on the side of the liquid accumulation plate 7 away from the plunger cylinder block 5. The pump body 21 is provided with a pump chamber 15, a diaphragm 9 is disposed near the diaphragm drive link 8, and the diaphragm 9 is connected with the diaphragm drive link 8. The pump chamber 15 is provided with an inlet 16 and an outlet 17 away from the diaphragm drive link, and an inlet one-way check valve 19 is disposed at the inlet 16 and an outlet one-way check valve 18 is disposed at the outlet 17.

Embodiment 2

In this embodiment, a driving fluid chamber oil pressure dynamic balancing system is provided between the low-pressure fluid chamber 22 and the driving fluid chamber 6. Considering the complexity of the overall structure design (space occupation) and working stability and other factors, the hydraulic dynamic balance system of the driving fluid chamber is integrated into the diaphragm driving connecting rod mounting seat in this embodiment.

Here, the structure after the diaphragm driving connecting rod mounting seat integrated with the driving chamber oil pressure dynamic balance system is called a diaphragm driving and protecting integrator, that is, the plunger diaphragm pump body provided with a liquid accumulation plate 7 is installed with a diaphragm driving and protecting integrator, the diaphragm driving and protecting integrator can not only drive the diaphragm action at the same time, but also prevent the plunger spring from breaking and tearing and other problems, More importantly, it also prevents the occurrence of a situation where the pressure in the driving chamber is lower than the pressure in the low-pressure chamber.

Figure 12:
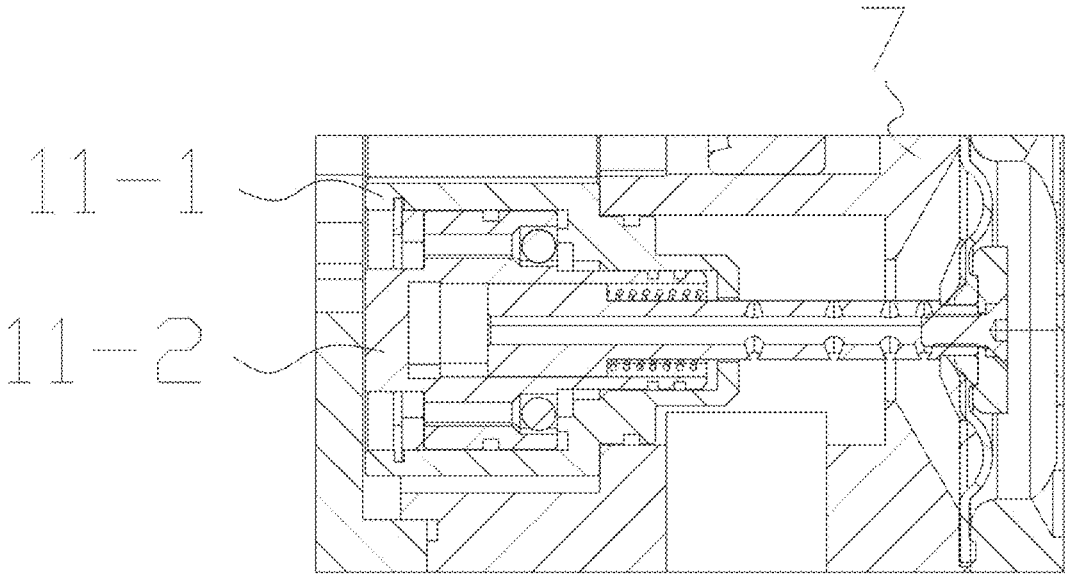
FIG. 12 is a sectional view of the diaphragm driving and protecting integrator in Embodiment 2.
Figure 13:
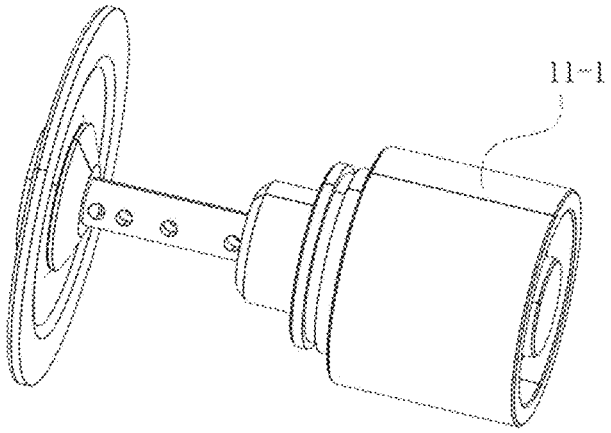
FIG. 13 is a three-dimensional view of the diaphragm driving and protecting integrator in Embodiment 2.
Figure 14:
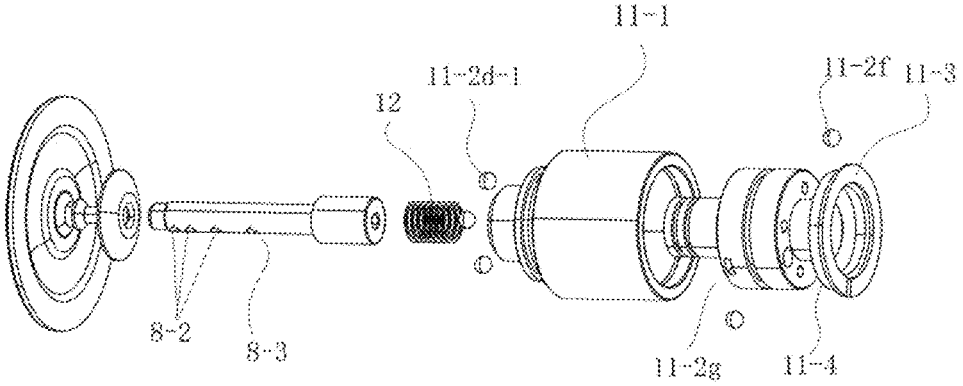
FIG. 14 is an explosion view of the diaphragm driving and protecting integrator in Embodiment 2.
Figure 15:
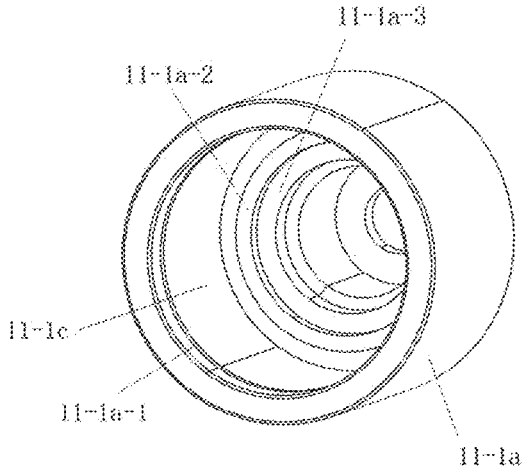
FIG. 15 is a three-dimensional view 1 of the integrator carrier in Embodiment 2.
Figure 16:
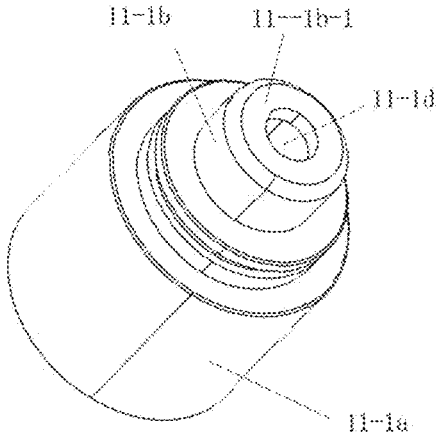
FIG. 16 is a three-dimensional view 2 of the integrator carrier in Embodiment 2.
Figure 17:
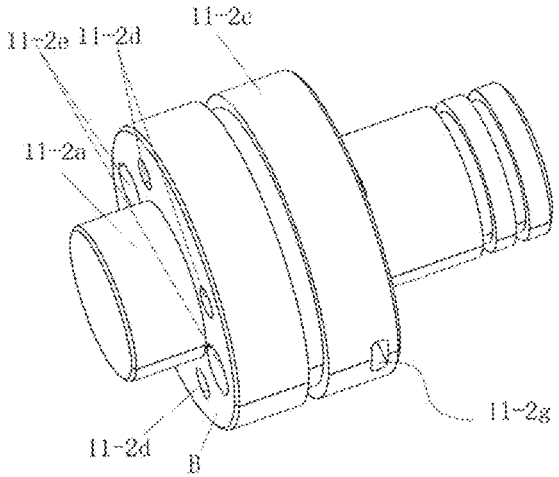
FIG. 17 is a three-dimensional view 1 of the core of the integrator in Embodiment 2.
Figure 18:
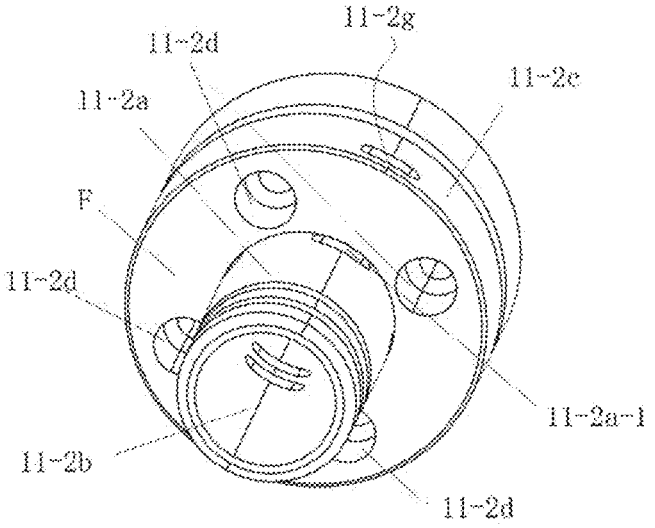
FIG. 18 is a three-dimensional view 2 of the core of the integrator in Embodiment 2.
Figure 19:
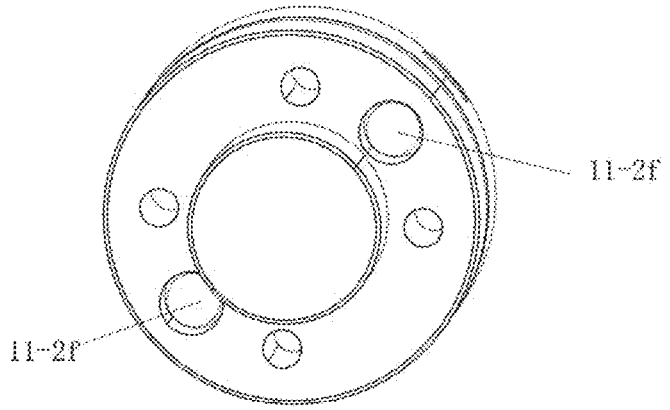
FIG. 19 is a three-dimensional view 3 of the core of the integrator in Embodiment 2.
Figure 20:
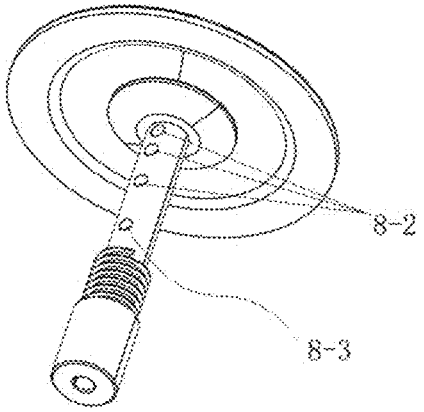
FIG. 20 is a three-dimensional view of the diaphragm driving connecting rod in Embodiment 2.
Figure 21:
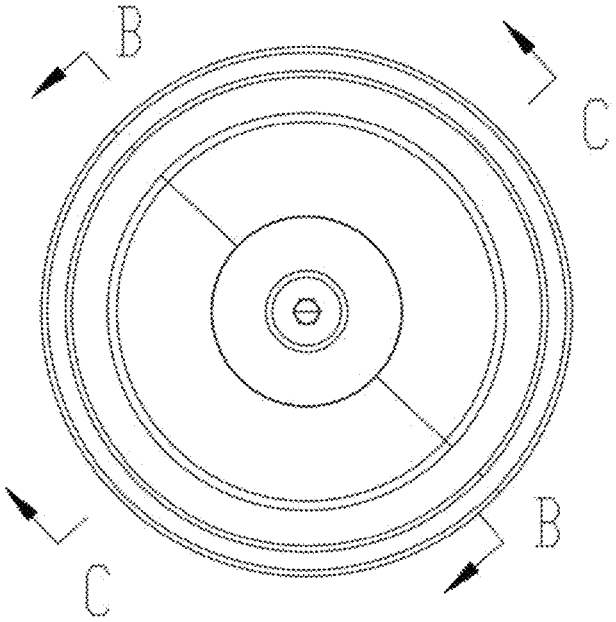
FIG. 21 is a bottom view of the diaphragm driving and protecting integrator in Embodiment 2.
Figure 22:
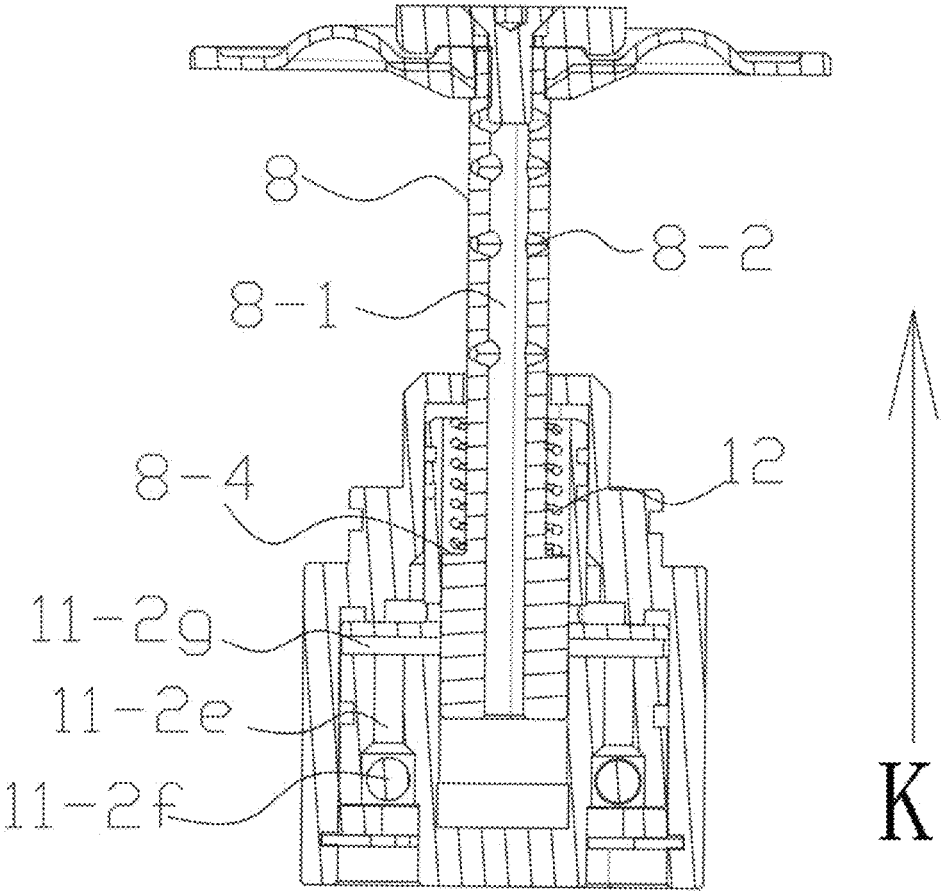
FIG. 22 is a sectional view in FIG. 21 along the B-B line.
Figure 23:
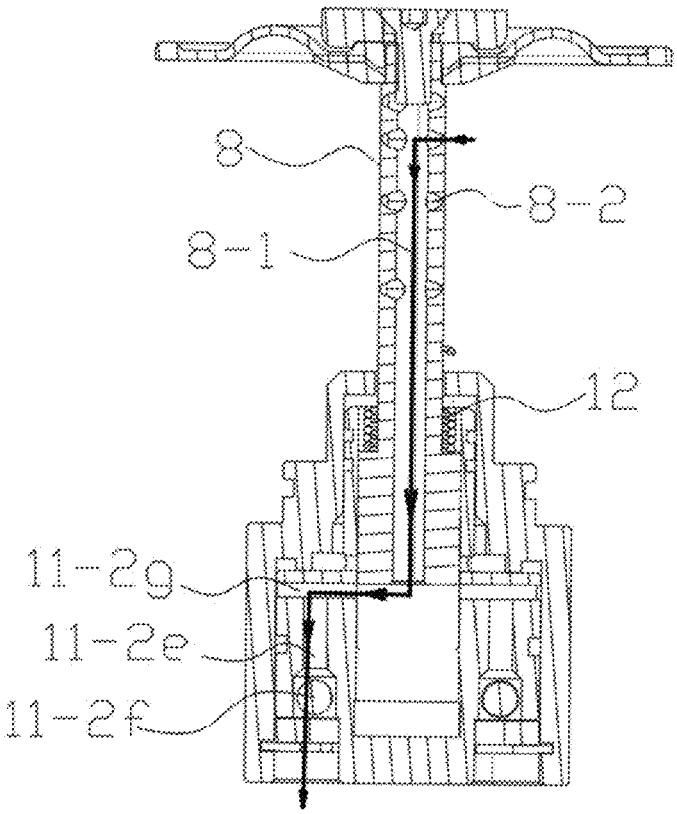
FIG. 23 is a working state view of the one-way relief valve when Embodiment 2 is operated.
Figure 24:
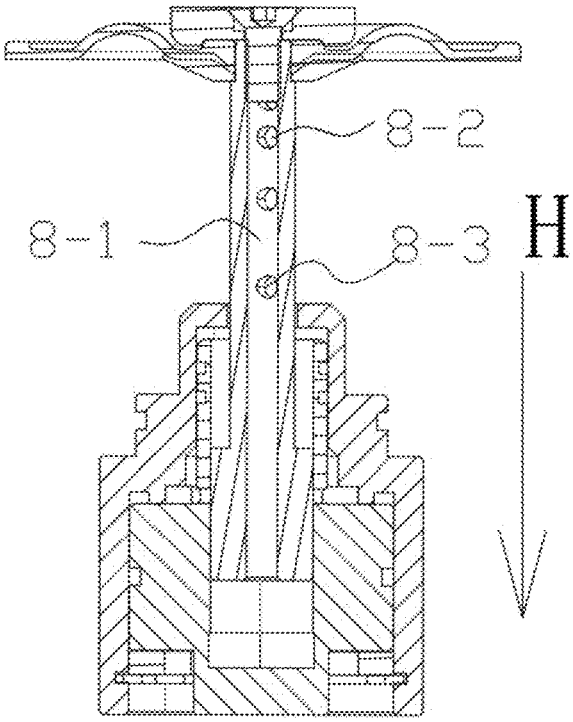
FIG. 24 is a sectional view in FIG. 21 along the C-C line.
Figure 25:
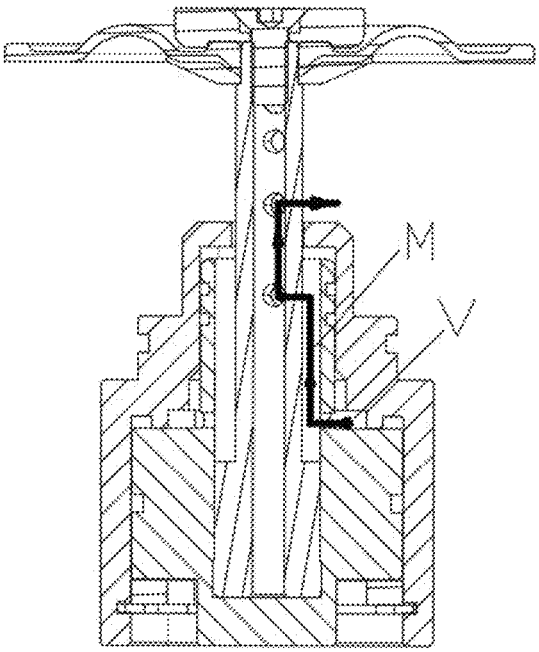
FIG. 25 is a working state view of the one-way replenishment valve in Embodiment 2, omitting the diaphragm driving connecting rod return spring.
Figure 26:
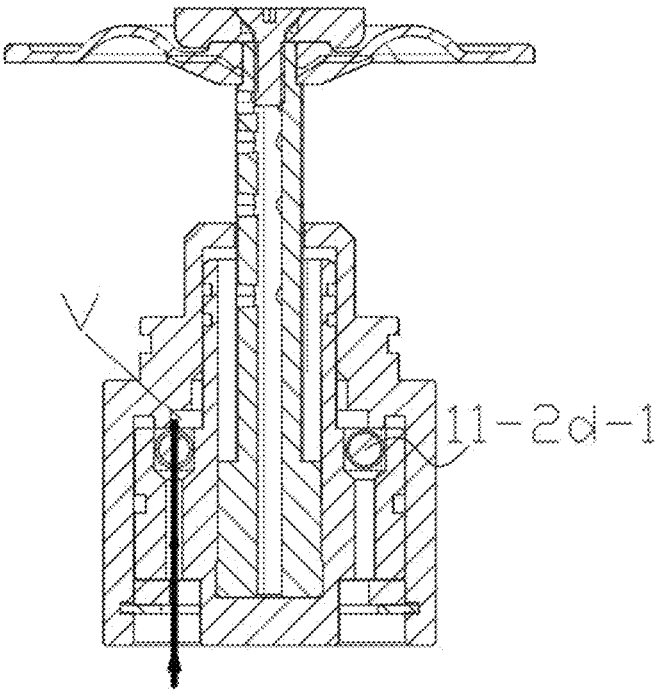
FIG. 26 is a cross-sectional view of the one-way fluid supply valve in Embodiment 2, omitting the diaphragm driving connecting rod return spring.
Figure 27:
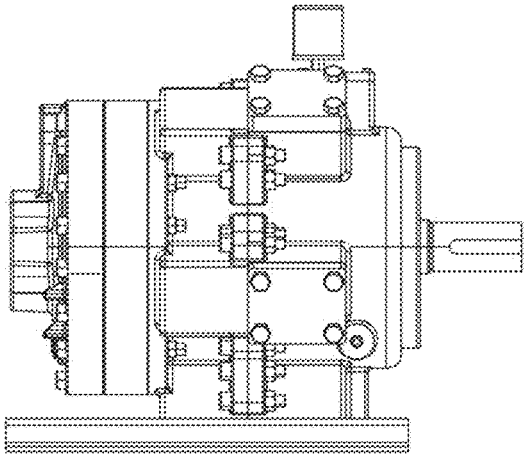
FIG. 27 is a front view of the plunger diaphragm pump in Embodiment 3.
Figure 28:
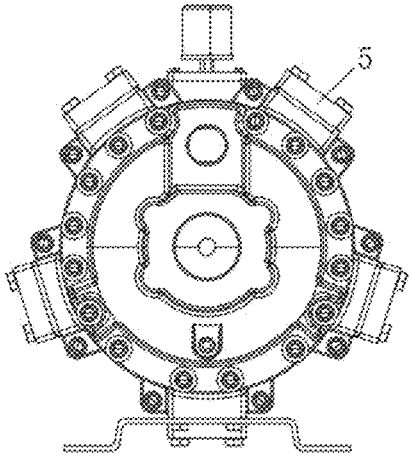
FIG. 28 is a left view of the plunger diaphragm pump in Embodiment 3.
Figure 29:
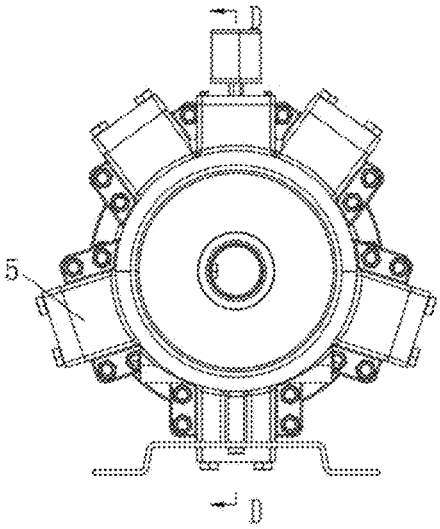
FIG. 29 is a right view of the plunger diaphragm pump in Embodiment 3.
Figure 30:
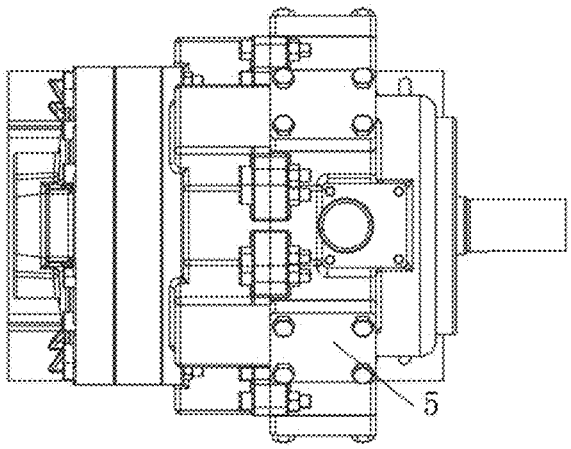
FIG. 30 is a top view of the plunger diaphragm pump in Embodiment 3.
Figure 31:
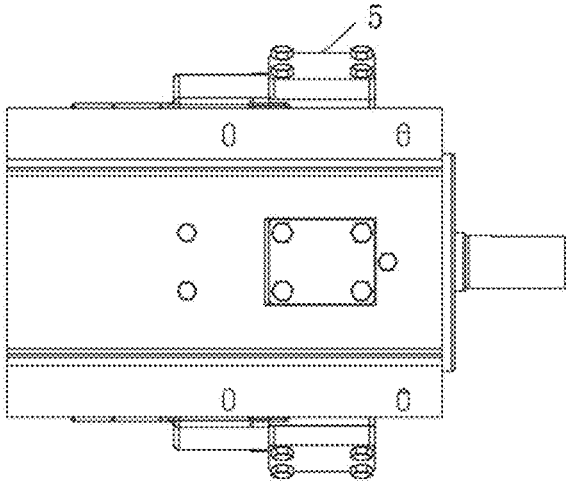
FIG. 31 is an upward view of the plunger diaphragm pump in Embodiment 3.
Figure 32:
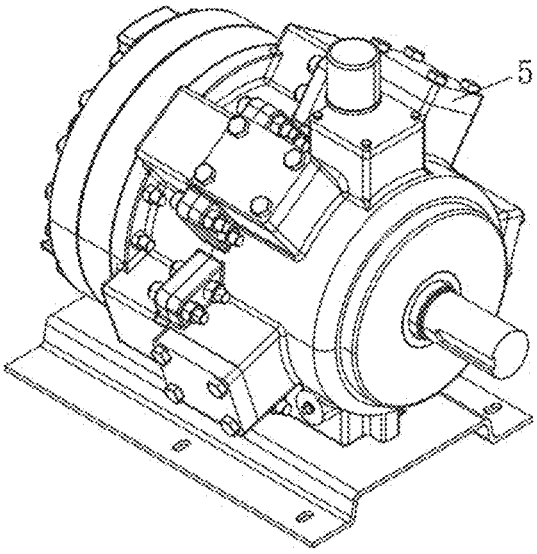
FIG. 32 is a three-dimensional view of the plunger diaphragm pump in Embodiment 3.
Figure 33:
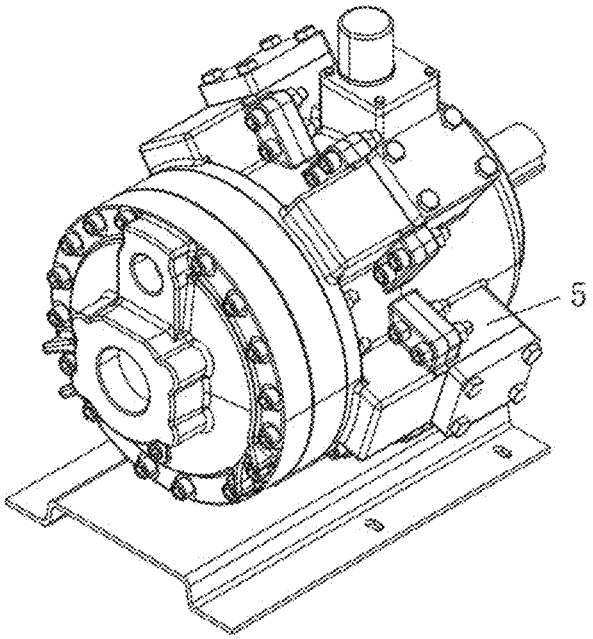
FIG. 33 is a three-dimensional view of the plunger diaphragm pump in Embodiment 3.
Figure 34:
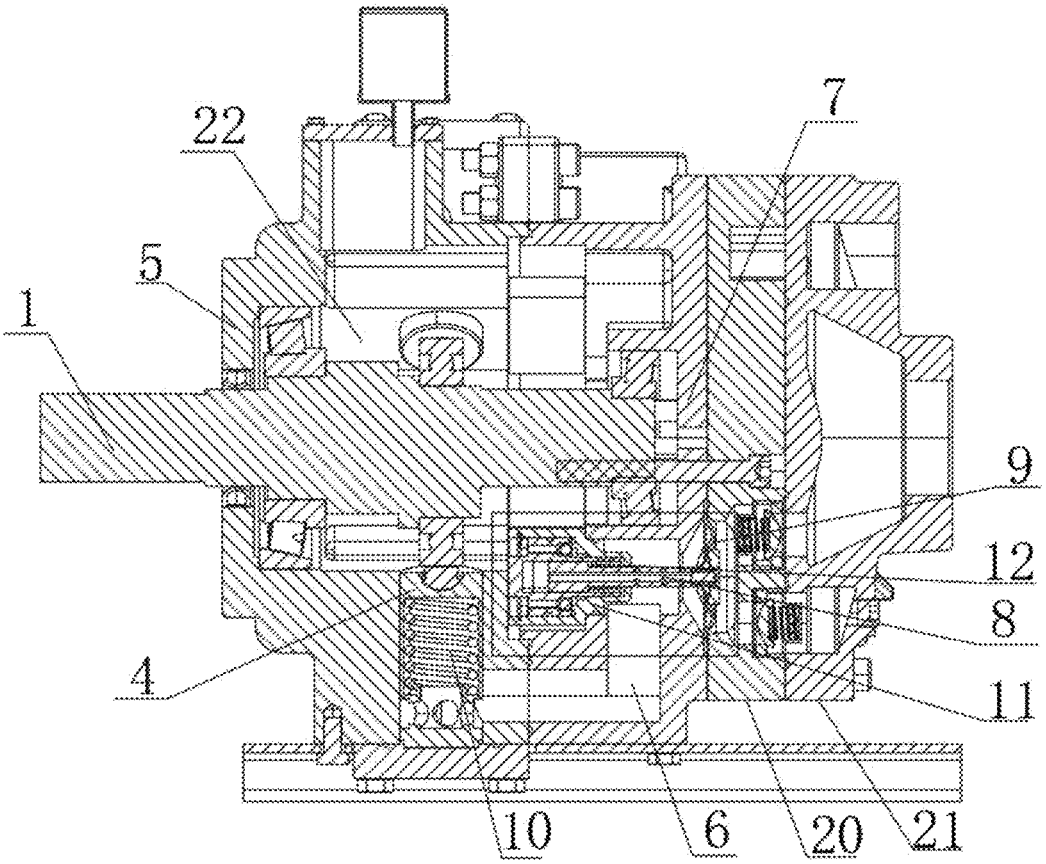
FIG. 34 is a sectional view in FIG. 29 along the D-D line.

As shown in FIG. 12, the diaphragm driving and protecting integrator 11 internal axial provided a one-way rehydration valve and a one-way pressure relief valve, the function of the one-way rehydration valve is to prevent the driving chamber pressure from lower than the pressure in the low-pressure chamber, to achieve the purpose of low-pressure protection. The function of the one-way pressure relief valve is to prevent the occurrence of excessive pressure in the driving liquid chamber, resulting in excessive accumulation of hydraulic pressure in the plunger cavity that cannot be released, resulting in problems such as fracture and fragmentation of the plunger spring and tearing of the diaphragm, and achieving the purpose of high-pressure protection. Specifically, referring to FIGS. 13-22, the diaphragm driving and protecting integrator 11 includes an integrator carrier 11-1, the integrator carrier 11-1 has a cylindrical bearing body 11-1 and an integrator carrier neck 11-1*b* disposed in a cylindrical bearing body 11-1, the cylindrical bearing body has a step-like inner cavity 11-1*c*, and the integrator carrier neck 11-1*b* is similarly provided with an intraneck channel 11-1*d* communicating with the step-like inner lumen, the cylindrical bearing body 11-1 The bottom is open, and the neck of the integrator carrier is also open, so that the integrator carrier is internally installed integrator core 11-2, the integrator core 11-2 includes a core post 11-2 for mounting a diaphragm driving connecting rod 8, the core post is provided with a diaphragm driving connecting rod action channel 11-2*b* that allows the diaphragm to drive the connecting rod back and forth, and a ring body 11-2*c* is provided in the core column, the ring body has a top F and a bottom B, At least one one-way replenishment valve assembly channel 11-2*d* parallel to the mandrel axis and at least one one-way pressure relief valve assembly channel 11-2*e* are provided on the annular body 11-2*c*, the one-way filling valve assembly channel 11-2*d* extends from the bottom of the annulus body towards the top surface and does not penetrate to the top surface F, and the one-way pressure relief valve assembly channel 11-2*e* extends from the bottom B of the annular body to the top surface F (compared to the one-way filling valve assembly channel is not through, this one-way pressure relief valve assembly channel is through on the annular body), A one-way pressure relief valve steel ball assembly channel with an inner diameter greater than the inner diameter of the one-way pressure relief valve 11-2*e* body diameter is provided near the bottom surface B of the annular body 11-2*e*, a one-way pressure relief valve ball assembly channel is equipped in the one-way pressure relief valve steel ball assembly channel, and an annular inner groove 11-1-1 is provided in the cylindrical bearing body 11-1, in which an integrator inner core fixing device 11-3 is provided in the annular inner groove 11-1-1, such as a non-closed annular elastomer such as a circlip, and here an annular retaining ring 11-4 can be added between the integrator inner core fixing device 11-3 and the integrator core can be used as an outlet limit structure of the one-way pressure relief valve ball 11-2F, and a pressure relief side hole 11-2*g* communicating with the one-way pressure relief valve assembly channel is provided radially near the top surface of the annular body, since the diaphragm driving and protecting integrator is provided with a diaphragm driving connecting rod 8 with inner channel 8-1, the diaphragm driving connecting rod sidewall is provided with at least one multi-function opening near the diaphragm end, the diaphragm driving connecting rod sidewall is also provided with a first rehydration opening 8-2 for refilling (as shown in FIG. 22), the diaphragm driving connecting rod step 8-4 is provided with a diaphragm driving connecting rod return spring 12, if the diaphragm driving connecting rod 8 moves along the arrow K direction shown in FIG. 22, if the pressure in the driving chamber continues to rise, the diaphragm and diaphragm driving connecting rod 8 move to the top of FIG. 22 (as shown in FIG. 23, the arrow in the figure is the path of the oil driving the chamber into the low-pressure chamber), The pressure relief side hole 11-2*g* is connected with the low-pressure liquid chamber through the one-way pressure relief valve, that is, the driving fluid of the driving liquid chamber enters the diaphragm driving connecting rod channel 8-1 from the multi-function opening hole 8-2, and then enters the one-way pressure relief valve assembly channel 11-2*e* through the pressure relief side hole 11-2*g*, and finally opens the one-way pressure relief valve ball 11-2F and allows the driving fluid to enter the low-pressure liquid chamber, when the pressure relief is completed, the diaphragm driving connecting rod will close the above channel after being reset under the action of the spring, diaphragm 9 In normal working condition without overvoltage being damaged. A first rehydration opening 8-3 is provided in the diaphragm driving connecting rod 8, and a plurality of second rehydration opening 11-2-1 are provided circumferentially near the top surface of the annular body 11-2, when the integrator core is installed into the inner cavity of the integrator carrier, the top surface F of the integrator core and the rehydration valve ball positioning protrusion 11-1-2 of the integrator carrier, the integrator carrier shoulder turning part 11-1-3 forms a slow flow chamber V, and the one-way replenishment valve assembly channel is close to the top surface F of the annulus The inner diameter at is greater than the inner diameter of the channel body channel in the one-way filling valve, which is convenient for installing the one-way filling valve ball **11-2*d*-1, if the diaphragm drives the connecting rod 8 along the arrow H shown in FIG. 24, the diaphragm and diaphragm drive the connecting rod to the bottom end shown in FIG. 24 (as shown in FIGS. 25-26, the arrow in the drawings is the route of the oil of the low-pressure liquid chamber into the driving chamber), if the pressure in the driving chamber 6 is lower than the pressure in the low-pressure liquid chamber 22, the unidirectional rehydration valve opens, and the diaphragm drives the connecting rod 8 so that the oil of the low-pressure liquid chamber enters the channel V of the slow-flow chamber from the channel in the one-way replenishment valve (see the arrow of FIG. 26), and the slow-flow chamber communicates with the second rehydration opening 11-2-1 at this time and allows the oil to continue to enter the transition cavity M between the diaphragm driving connecting rod and the core column 11-2, and then from the first rehydration opening 1 8-3 into the diaphragm driving connecting rod inner channel, and finally the oil enters the driving chamber through the multi-function opening 8-2. In the present embodiment, the one-way pressure relief valve assembly channel 11-2*e* is provided with two, and the one-way replenishment valve assembly channel 11-2*d*** is provided with four, and the corresponding number of structural settings is matched.

The above content describes the diaphragm driving and protecting integrator fluid replenishment and pressure relief work process, from the above can be seen that the structure can not only protect the diaphragm from overpressure (overstroke) damage, but also avoid spring damage caused by equipment early overhaul and other problems.

Example 3

A plunger diaphragm pump includes a hydraulic linkage plunger push mechanism, herein an example of a five-plunger plunger diaphragm pump is described in detail. As shown in FIGS. 27-34, the piston diaphragm pump has a plunger block 5, five plunger blocks are arranged on the plunger pump casing, a fluid accumulation plate 7 is provided on one side of the plunger block 5, a low pressure liquid chamber 22 (for setting low pressure oil) and a drive fluid chamber 6 (for setting the drive fluid) between the plunger block 5 and the accumulation plate 7, a crankshaft 1 is provided at the low pressure liquid chamber 22, the crankshaft extends out of the plunger block 7 and is connected to an external motor, and the first end of the crankshaft S1 is mounted at the first assembly chamber and the second end is installed at the first assembly chamber by the first assembly bearing P1 S2 is installed in the second assembly cavity through the second assembly bearing P2, a sealing structure is provided between the crankshaft and the plunger cylinder block to avoid the leakage of low-pressure oil, the eccentric part of the crankshaft 1 (eccentric, that is, the eccentric cylindrical position) is provided bearing 2, the bearing can use the eccentric design of the crankshaft to slide (roll) to touch the plunger in turn during the rotation of the crankshaft to complete the push action, the plunger block 5 is provided with a plunger 4, the present embodiment has five plungers, so that five plungers are provided around the low-pressure oil chamber, one or the remaining number of plungers can be set up as needed, and this is just an example. The plunger 4 is provided with a return spring 10 on one side (one end of the return spring is connected to the push head and the other end is connected to the accumulation plate), the plunger 4 is provided with a spherical surface on the other side, a push head 3 is provided at the spherical surface, the push head 3 is matched with bearing 2 (the push head and the bearing are in free contact), and the diaphragm driving and protecting integrator 11 is provided at the accumulation plate 7, the diaphragm driving connecting rod 8 is provided at the diaphragm driving and protecting integrator 11, and the diaphragm driving connecting rod return spring 12 is provided at the diaphragm driving connecting rod 8 (one end of the diaphragm driving connecting rod return spring is connected to the diaphragm driving connecting rod, the other end is connected to the diaphragm driving and protecting integrator).

The liquid accumulation plate 7 away from the plunger cylinder block 5 side successively provided pump body and pump cover, the pump body has a pump cavity, the pump cavity is provided near the diaphragm driving connecting rod diaphragm 9, diaphragm 9 and diaphragm driving connecting rod 8 connected, the pump cavity is set from the diaphragm plunger at the inlet and outlet, the inlet check valve is provided at the inlet, and the outlet check valve is provided at the outlet.

The crankshaft and the return spring drive the radially arranged plunger reciprocating motion through the bearings on the crankshaft, such arrangement makes the product compact, less friction, high efficiency; The reciprocating movement of the plunger causes a volume change in the hydraulic drive fluid. Hydraulic drive fluid makes the diaphragm (diaphragm) at the pump cavity produce concave and convex deformation and reciprocating movement, the pump cavity inlet and outlet on the pump body are equipped with a one-way check valve, the medium at the outlet one-way check valve can only flow out can not flow in, the medium at the inlet one-way check valve can only flow in and not out, when the diaphragm drives the connecting rod to the right, the diaphragm gradually concave, the volume in the pump chamber gradually increases, the pressure gradually decreases, when it is lower than the pressure at the inlet at the pump cover, the inlet check valve opens, the medium flows into the pump cavity, and the plunger reaches the limit position at the right end, the medium fills the pump chamber and the inlet valve is closed. The suction process is completed and the extrusion process begins. When the plunger moves to the left, the diaphragm gradually bulges, the volume in the pump cavity gradually becomes smaller, the pressure gradually increases, the outlet check valve opens, the medium is gradually discharged to the outlet at the pump cover, when the plunger reaches the limit position at the left end, the outlet check valve closes due to the spring thrust, the discharge process ends, and the pump starts a new suction process, so that the medium can be continuously sucked in and discharged. The main function of the diaphragm is to close the mechanical moving parts, and the medium and mechanical parts are completely non-contact, achieving the effect of no leakage, so as to realize the leak-free and environmentally friendly operation of the equipment. The plunger diaphragm pump is mainly used in the high-pressure transportation of various pure liquids, solvents and chemical liquids, corrosive liquids, liquefied gases, slurries, and high-viscosity materials. It is suitable for high-pressure filtration and separation equipment, high-pressure cleaning equipment, high-pressure cooling equipment, seawater desalination and reverses osmosis equipment, oil and gas field pressure water injection equipment, spray drying equipment, deep hole processing equipment, multi-channel reaction equipment, high-pressure DC boilers and high-pressure equipment with general quantitative liquid delivery requirements.

Embodiment 4

Figure 35:
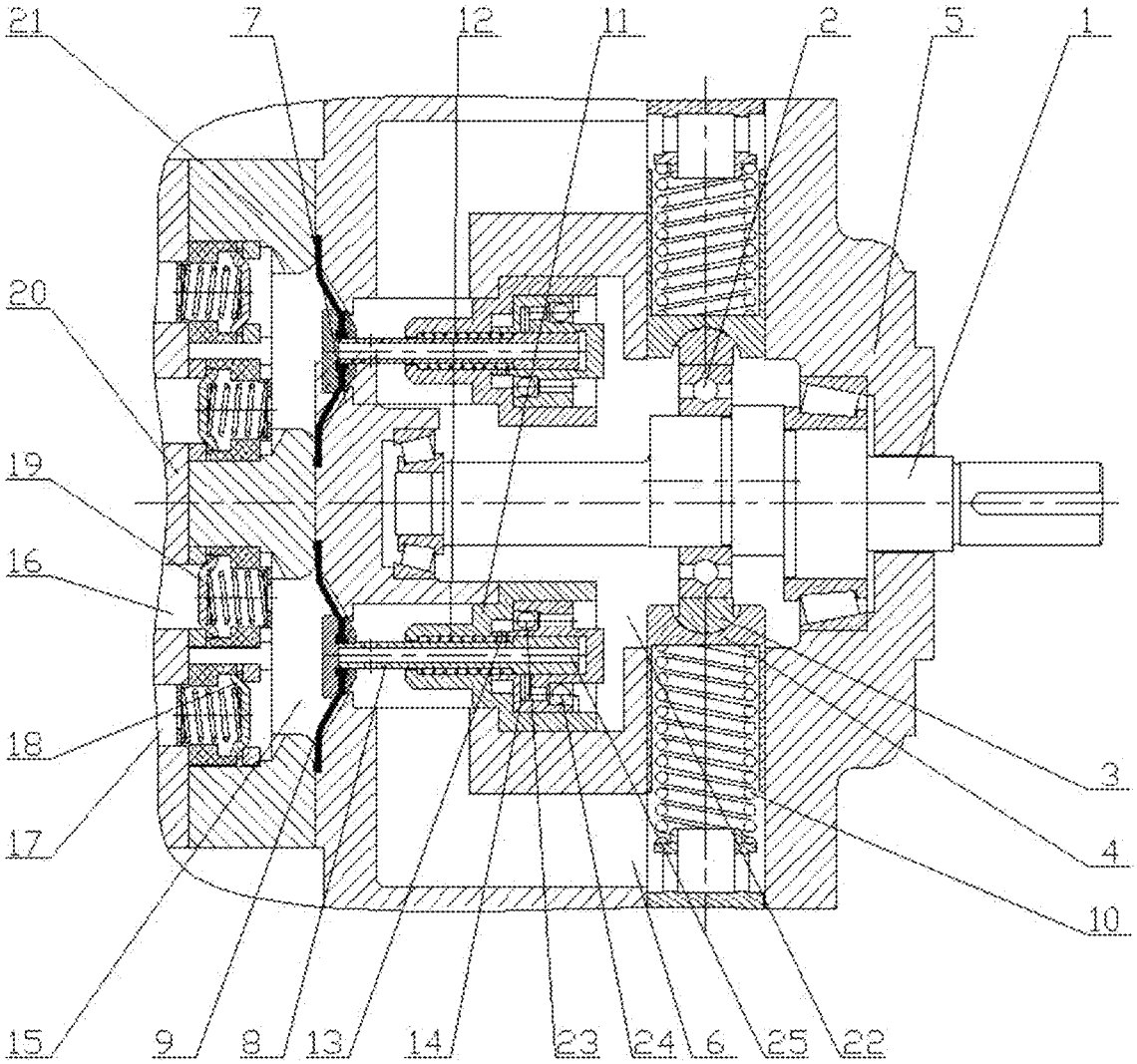
FIG. 35 is a sectional view of the plunger diaphragm pump in one direction in Embodiment 4.
Figure 36:
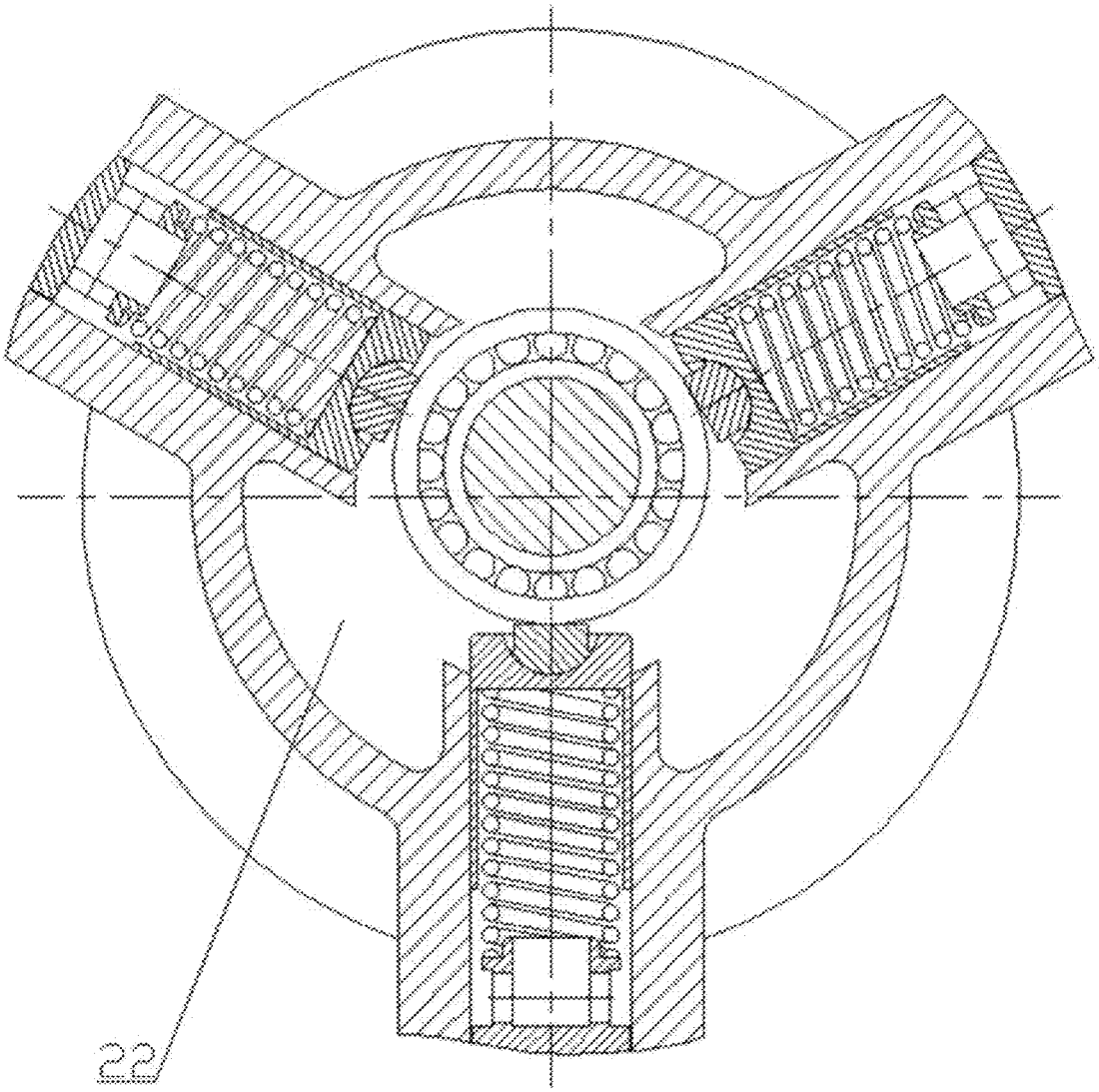
FIG. 36 is a sectional view of the other direction of the plunger diaphragm pump in Embodiment 4.
Figure 37:
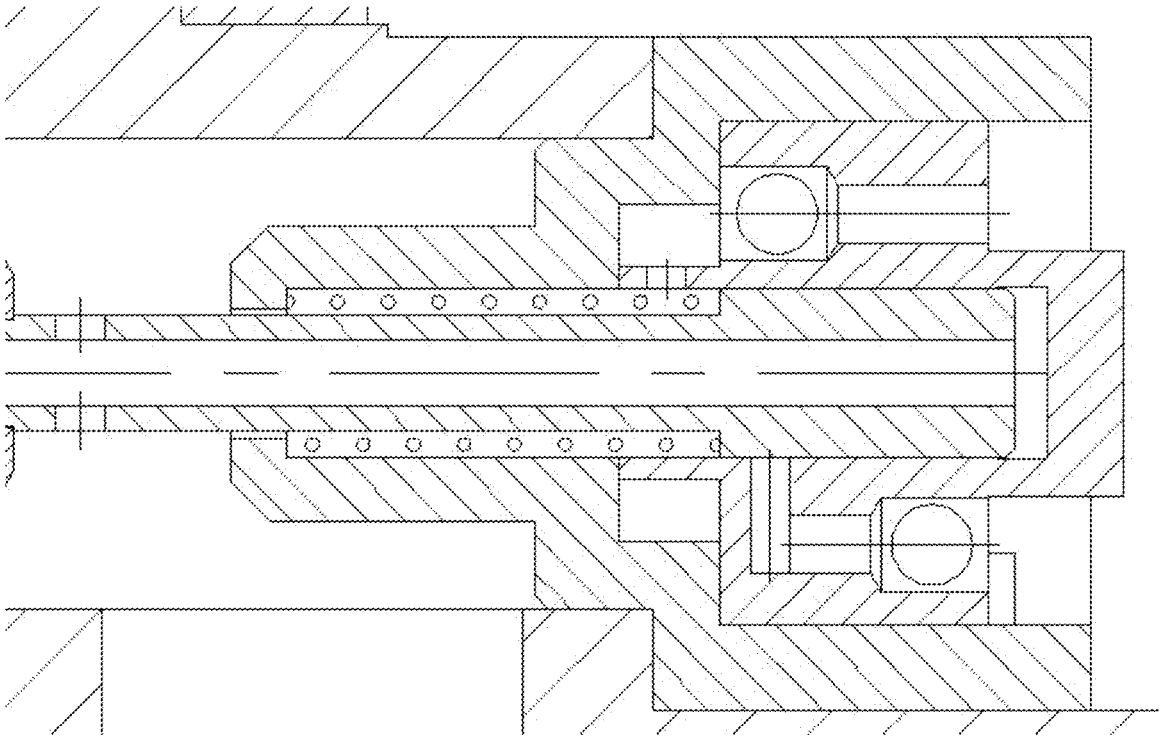
FIG. 37 is a partially enlarged view of the diaphragm driving connecting rod in Embodiment 4.

As shown in FIGS. 35 to 37, the plunger diaphragm pump includes a body; the body has a plunger block 5 provided with a fluid accumulation plate 7, the plunger block 5 (with the same meaning as the plunger cylinder block above) and a liquid accumulation plate 7 between a low-pressure liquid chamber 22 (for setting low pressure oil) and a drive fluid chamber 6 (for setting the drive fluid), the crankshaft 1 is provided at the low pressure liquid chamber 22, the eccentric portion (eccentricity) of the crankshaft 1 is provided bearing 2, the plunger plate 5 is provided with a plunger 4, one side of the plunger 4 is provided with a return spring 10 (one end of the return spring is connected to the push head and the other end is connected to the accumulation plate), the plunger 4 is provided with a spherical surface on the other side, a push head 3 is provided at the spherical surface, the push head 3 is matched with bearing 2 (the push head and the bearing are in free contact), the plunger valve 11 is provided at the accumulation plate 7 (with the same meaning as the diaphragm driving and protecting integrator above), the plunger valve 11 is provided with a diaphragm plunger 8 (also has the same meaning as the diaphragm driving connecting rod above), and a bias spring 12 is set at the diaphragm plunger 8 (one end of the bias spring is connected to the diaphragm plunger and the other end is connected to the plunger valve) (also has the same meaning as the diaphragm driving connecting rod return spring above).

The liquid accumulation plate 7 away from the plunger plate 5 is provided sequentially with a pump body 21 and a pump cover 20 on the one side, the pump body 21 has a pump cavity 15, the pump cavity 15 is provided close to the diaphragm 9, the diaphragm 9 and the diaphragm driving rod are connected, the pump cavity 15 away from the diaphragm plunger is provided with an inlet 16 and an outlet 17, the inlet 16 is provided with an inlet check valve 19, the outlet 17 is provided with an outlet check valve 18.

The crankshaft and the return spring drive the radially arranged plunger reciprocating motion through the bearings on the crankshaft, such arrangement makes the product compact, with less friction and high efficiency. The reciprocating movement of the plunger causes a volume change in the hydraulic drive fluid. The hydraulic drive fluid causes the diaphragm (diaphragm) at the pump cavity 15 to produce concave and convex deformation and reciprocating movement, the pump cavity inlet and outlet on the pump body 21 are equipped with one-way check valves, the outlet one-way check valve 18 the medium can only flow out and can not flow in, the inlet check valve 19 the medium can only flow in and not out when the small plunger (diaphragm plunger) moves to the right, the diaphragm gradually concaves, the volume in the pump chamber gradually increases, the pressure gradually decreases, lower than the pressure at the inlet 20 at the pump cover 16, the inlet check valve 19 opens, The medium flows into the pump chamber 15, and when the plunger reaches the right end limit position, the medium fills the pump chamber and the inlet valve closes. The suction process is completed and the extrusion process begins. When the plunger moves to the left, the diaphragm gradually bulges, the volume in the pump chamber gradually becomes smaller, the pressure gradually increases, the outlet check valve 18 opens, the medium is gradually discharged to the outlet 17 at the pump cover 20, when the plunger reaches the limit position at the left end, the outlet check valve closes due to the spring thrust, the discharge process ends, and the pump starts a new suction process, so that the medium can be continuously sucked in and discharged. The main function of the diaphragm is to close the mechanical moving parts, and the medium and mechanical parts are completely non-contact, achieving the effect of no leakage, so as to realize the leak-free and environmentally friendly operation of the equipment.

It should be noted that the plunger portion (including plunger, push head, and return spring) and diaphragm plunger portion (including diaphragm plunger, plunger valve, bias spring, diaphragm, inlet, outlet, pump cavity, inlet check valve, outlet check valve) number is corresponding, the number of plunger portion settings can be 1, diaphragm plunger portion setting quantity is also 1. If the number of plunger section settings can be multiple (e.g., 3, as shown in the drawing), the number of diaphragm plunger section settings is also multiple (e.g., 3, as shown in the drawing).

The plunger diaphragm pump is mainly used in a variety of pure liquids, solvents and chemical liquids, corrosive liquids, liquefied gases, slurries, high viscosity materials of high-pressure transportation; It is adapted for high-pressure filtration and separation equipment, high-pressure cleaning equipment, high-pressure cooling equipment, seawater desalination and reverse osmosis equipment, oil and gas field pressure water injection equipment, spray drying equipment, deep hole processing equipment, multi-channel reaction equipment, high-pressure boilers and high-pressure equipment with general quantitative liquid delivery requirements.

The full disclosure omits the description of the prior art, and the above is only a preferred embodiment of the present invention, the scope of protection of the present invention is not limited to the above embodiments, all technical solutions belonging to the principles of the present invention are within the scope of protection of the present invention. For those skilled in the art, without departing from the principles of the present invention a number of improvements, these improvements should also be regarded as the scope of protection of the present invention.

What is claimed is:

1. A hydraulic linkage plunger pushing mechanism for a plunger diaphragm pump body with a low-pressure liquid chamber and a plunger, comprising:

a diaphragm driving and protecting integrator;

a bearing assembly; and a crankshaft disposed in the low-pressure liquid chamber in the plunger diaphragm pump body through the bearing assembly, wherein the plunger diaphragm pump body comprises a liquid accumulation plate and the diaphragm driving and protecting integrator is disposed at the liquid accumulation plate of the plunger diaphragm pump body, wherein the crankshaft comprising an eccentric part, and the eccentric part of the crankshaft sleeved with a bearing, wherein in the case where the crankshaft rotates along a crankshaft axis thereof, the bearing disposed at the eccentric part of the crankshaft pushes the plunger to compress, wherein the diaphragm driving and protecting integrator comprises an integrator carrier and an integrator inner core disposed at the integrator carrier, the integrator inner core comprises a core column and an annular body disposed at the core column, the core column is sleeved with a diaphragm driving connecting rod, and the annular body is provided with at least one unidirectional rehydration valve assembly channel and at least one unidirectional pressure relief valve assembly channel.

2. The hydraulic linkage plunger pushing mechanism for a plunger diaphragm pump body with a low-pressure liquid chamber and a plunger according to claim 1, wherein the diaphragm driving and protecting integrator is provided with the diaphragm driving connecting rod with an inner channel, one end of a side wall of the diaphragm driving connecting rod near a diaphragm is provided with at least one multifunctional opening, the side wall of the diaphragm driving connecting rod is provided with a first rehydration opening for rehydration, and the diaphragm driving connecting rod is provided with a return spring.

3. The hydraulic linkage plunger pushing mechanism for a plunger diaphragm pump body with a low-pressure liquid chamber and a plunger according to claim 2, wherein, the plunger diaphragm pump body has a driving fluid chamber, and the diaphragm driving and protecting integrator comprises a one-way rehydration valve to prevent the pressure in the driving fluid chamber from being lower than the pressure in the low-pressure fluid chamber and a one-way pressure relief valve to prevent excessive pressure in the driving liquid chamber.

* * * * *